United States Patent [19]

Popp et al.

[11] Patent Number: 4,527,065

[45] Date of Patent: Jul. 2, 1985

[54] CONTAINER FOR THE LONG-TERM STORAGE OF RADIOACTIVE MATERIALS SUCH AS IRRADIATED NUCLEAR FUEL ELEMENTS

[75] Inventors: Franz-Wolfgang Popp, Wedemark; Klaus Rosenbach, Bissendorf, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 451,935

[22] Filed: Dec. 21, 1982

[30] Foreign Application Priority Data

Dec. 22, 1981 [DE] Fed. Rep. of Germany ..... 3150711

[51] Int. Cl.[3] ..... G21F 5/00

[52] U.S. Cl. ..... 250/506.1; 376/272

[58] Field of Search ..... 252/633, 632, 631, 630; 376/272, 250, 450; 220/83, 84, 85 K, 71; 250/506.1, 507.1

[56] References Cited

U.S. PATENT DOCUMENTS

| | | | |
|---|---|---|---|
| 2,009,606 | 7/1935 | Diffenderfer | 220/83 |
| 2,384,067 | 9/1945 | Ballintine | 220/84 |
| 3,111,586 | 11/1963 | Rogers | 376/272 |
| 3,229,096 | 1/1966 | Bonilla et al. | 376/272 |
| 4,447,730 | 5/1984 | Botzem et al. | 250/506.1 |

*Primary Examiner*—Alfred E. Smith
*Assistant Examiner*—Richard E. Hanig
*Attorney, Agent, or Firm*—Walter Ottesen

[57] ABSTRACT

The invention is directed to a container for the long-term storage of radioactive materials such as irradiated nuclear fuel elements. The container includes a vessel-shaped base body made of a material selected from the group including cast iron and cast steel. The base body has an outer surface and an opening through which the radioactive materials to be stored therein are passed. A plurality of ribs made of corrosion-resistant material are formed on the outer surface of the base-body to partition this surface into a plurality of surface segments. A protective layer covers each of the surface segments to protect the same against corrosion. A cover is adapted for sealing the opening of the vessel-shaped base body. The ribs and their arrangement on the surface of the base body of the vessel make it easier to apply the corrosion protective layer and make the layer less sensitive to differential expansion stresses of the contiguous materials.

6 Claims, 2 Drawing Figures

CONTAINER FOR THE LONG-TERM STORAGE OF RADIOACTIVE MATERIALS SUCH AS IRRADIATED NUCLEAR FUEL ELEMENTS

FIELD OF THE INVENTION

The invention relates to cast steel or cast iron containers for the long-term storage of irradiated nuclear reactor fuel elements or other radioactive materials. The containers have an external corrosion-resistant protective layer, preferably of a material such as ceramic, graphite or enamel.

BACKGROUND OF THE INVENTION

Containers for the long-term storage of radioactive materials must be mechanically stable, corrosion-resistant and sealed. The vessel of the container is therefore made from a material selected from the group including cast steel or cast iron to ensure that the container has the required mechanical stability.

The resistance of cast steel or cast iron to corrosion is unsatisfactory for the purposes of long-term storage. It has therefore already been proposed that a corrosion-resistant protective layer be applied to the exterior of the cast steel or cast iron vessel of the container. Ceramic, graphite or enamel are suitable for forming the protective layer because of their good resistance to corrosion. It is also possible to use metallic corrosion-resistant layers which are applied galvanically or by thermal spraying. The operation of coating the large surface area of the vessel of the container is a technically expensive one. Due to the different properties of the material of the protective layer and the metal base body of the vessel of the container, there are differences in expansion, which result in stresses between the two contiguous surfaces. There is thus the danger of stress cracks being formed and the protective layer becoming detached.

SUMMARY OF THE INVENTION

In view of the foregoing, it is an object of the invention to provide a container of the kind described above which has a corrosion protective coating that is simpler to apply and that is less sensitive to differential expansion stresses of the two contiguous materials.

A container of the invention for the long-term storage of radioactive materials such as irradiated nuclear fuel elements includes a vessel-shaped base body made of a material selected from the group including cast iron and cast steel. The base body has an outer surface and an opening through which the radioactive material to be stored therein is passed. According to a feature of the invention, rib means made of corrosion-resistant material is formed on the surface of the base body to partition the same into a plurality of surface segments. A protective corrosion-resistant layer covers each of the surface segments. A cover is adapted for sealing the opening of the vessel-shaped body.

The rib means can be a plurality of ribs projecting upwardly from the surface of the base body; and the protective coating can be made of a material selected from the group including: ceramic, graphite and enamel.

The ribs which project from the outside surface of the base body divide the outer surface of the base body of the container vessel into surface segments. Each surface segment is of a smaller area than the entire surface of the vessel and can therefore be more easily coated than the entire vessel. Differential expansion stresses between the corrosion protective layer and the base body can be absorbed by the ribs. The ribs also serve to enhance the adhesion strength of the corrosion protective layer because each surface segment of the corrosion protective layer is held fast between the ribs.

In an advantageous embodiment of the invention, the ribs are metal ribs which are applied to the surface of the base body of the vessel by the process of surface-layer welding and are made of a cold-weldable corrosion-resistant material. This process is described, for example, in the text "Handbuch der Schweisstechnik" by J. Ruge, Volume I, Second Edition, page 170, published by Springer-Verlag (1980).

It is noted that a cold-weldable material is a material which can be welded without the necessity of conducting a follow-up heat treatment operation. A cold-weldable corrosion-resistant material of this kind of which the ribs can be made is NiMo16Cr16Ti, which is known in Germany under the trade name "Hastelloy C-4."

The surface segments which are thus formed between the ribs can now be coated with a corrosion-resistant material for example by enamelling or thermal spraying. If the metal ribs project beyond the surface of the corrosion-resistant protective layer, the latter is protected from mechanical loadings.

It has been found particularly advantageous for the edges of the vessel to be provided with rib planting or cladding. The edges of a container are generally required to withstand a higher mechanical loading than the surfaces of the container. Applying corrosion-resistant protective layers at the edges of the container can lead to difficulty because it is possible that the protective layer can rupture and break away from the vessel body at these edges.

BRIEF DESCRIPTION OF THE DRAWING

The invention will now be described with reference to the drawing wherein.

DESCRIPTION OF THE PREFERRED EMBODIMENTS OF THE INVENTION

Figure 1:
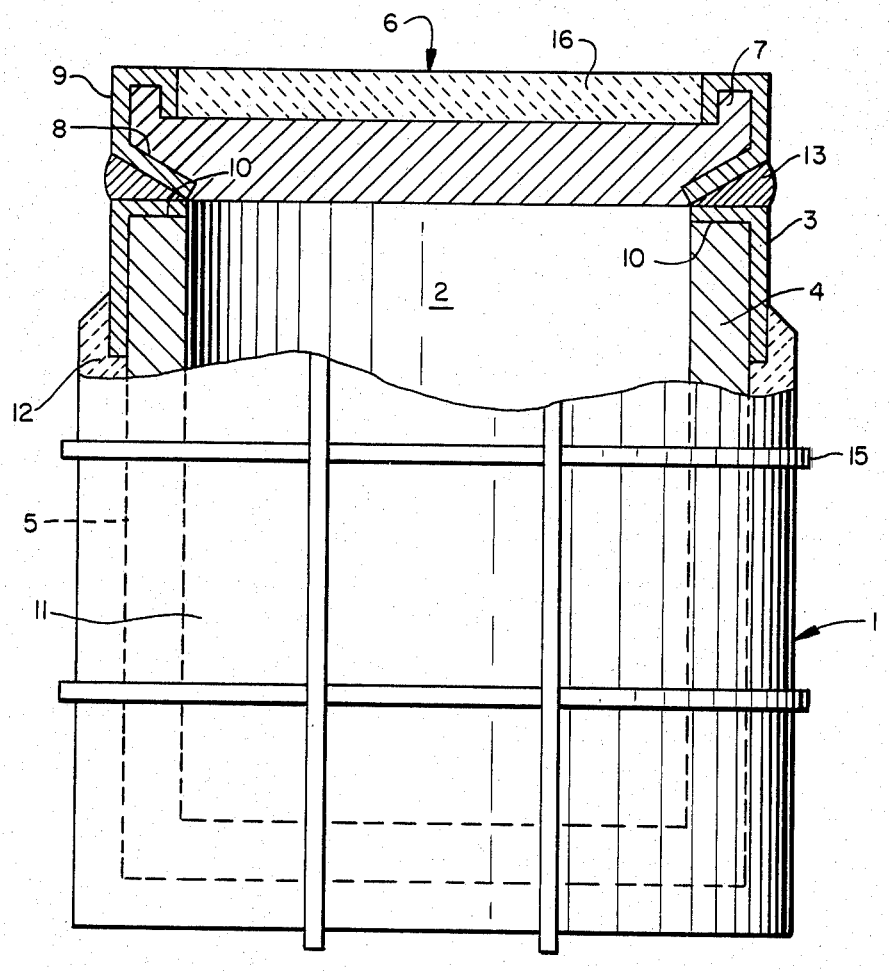
FIG. 1 is an elevation view, partially in section, illustrating a container according to the invention.

The container for storing radioactive material includes a cylindrical vessel 1 which is open at one end. In this way, the upper end portion of the vessel defines the receiving opening 2 for loading the vessel with fuel elements (not shown). The cover and vessel are made of a mechanically strong material. The vessel 1 includes a vessel-shaped base body 4 made of a material such as cast iron or cast steel. The cover has a main body also made of cast iron or cast steel and is provided with a protective layer 16 of corrosion-resistant material such as ceramic.

The upper end portion of the vessel 1 and the peripheral portion of the cover 6 define respective joint surfaces 10 and 8. These joint surfaces are mutually adjacent and define the partition interface between the vessel 1 and cover 6 when the cover is seated on the vessel.

A weld plating 3 is applied to joint surface 10 of the upper end portion of the vessel 1 and to a portion of the outside surface of the vessel as shown. The weld plating 3 is annular and is made of cold-weldable, corrosive resistant material. A material of the kind from which the annular weld plating is made is an alloy NiMo16Cr16Ti having the tradename Hastelloy C-4.

The vessel 1 is closed by the sealing cover 6 welded thereto. This cover 6 has a peripheral portion which includes an annular upwardly extending projection 7 formed at the outer surface thereof. At the region of the peripheral portion facing the vessel 1, the cover 6 is beveled to define the circular annular surface 8.

The peripheral portion of the cover 6 is enclosed about its entire periphery with a weld plating 9 likewise made of a cold-weldable material. The weld plating is in the form of an annular band extending laterally from the projection 7 to the inner edge of the annular surface 8.

The weld platings 3 and 9 are applied to the vessel 1 and to the cover 6, respectively, by surface-layer welding and are built up by depositing layer upon layer of the cold weldable material Hastelloy C-4. A weld 13 of cold-weldable material seals the cover 6 to the vessel 1 after the vessel has been filled with radioactive material. For further details directed to the partition interface and the joining of the cover 6 to the vessel 1, reference may be had to the copending patent application of Franz-Wolfgang Popp entitled "A Container for the Long-Term Storage of Radioactive Materials" filed on Dec. 14, 1982 and having Ser. No. 449,567.

Ribs 15 of a corrosion-resistant material are applied to the vessel-shaped base body 4 of the vessel 1 on the external surface 5 thereof by the surface-layer welding process. The ribs extend parallel to the longitudinal axis of the base body and about the periphery thereof as shown. NiMo16Cr16Ti known commercially as Hastelloy C-4 was selected as the material for the ribs. The plurality of ribs 15 partition the outside surface 5 of the base body 4 into segment-like areas 11. In these areas, the base body 4 is coated with a corrosion-resistant protective layer 12 of ceramic material which is applied by spraying the material into each segment area formed by the plurality of ribs 15. The point of attachment of the ribs 15 is covered by the ceramic material applied to the base body 4. The ribs 15 project somewhat beyond the surface of the ceramic protective layer 12. By virtue of this arrangement, the metallic ribs 15 provide mechanical protection for the ceramic protective layer areas.

Figure 2:
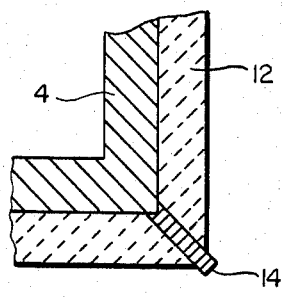
FIG. 2 is a fragmentary elevation view, in section, showing how the bottom peripheral edge of the vessel can be provided with a rib plating to enable the container to withstand mechanical loading while at the same time protecting the layer of corrosion-resistant material.

FIG. 2 shows a portion of the lower part of the vessel 1 of a container of the type illustrated in FIG. 1. Here, the lower peripheral edge of the vessel is provided with a rib plating 14 to enable the container to withstand a higher mechanical loading. This arrangement protects the protective layer 12 from rupturing and breaking away from the base body at the peripheral edge.

Other modifications and variations to the embodiments described will not be apparent to those skilled in the art. Accordingly, the aforesaid embodiments are not to be construed as limiting the breadth of the invention. The full scope and extent of the present contribution can only be appreciated in view of the appended claims.

What is claimed is:

1. A container for the long-term storage of radioactive materials such as irradiated nuclear fuel elements, the container comprising:

a vessel-shaped base body made of a material selected from the group consisting of cast iron and cast steel, said base body having an outer surface and an opening through which the radioactive material to be stored therein is passed;

rib means made of corrosion-resistant material and formed on said surface to partition said surface into a plurality of surface segments;

protective means covering each of said surface segments for protecting the same against corrosion; and, a cover adapted for sealing said opening of said vessel-shaped base body.

2. The container of claim 1, said rib means being a plurality of ribs projecting upwardly from said surface of said base body; and, said protective means being a corrosion-resistant layer made of a material selected from the group including: ceramic, graphite and enamel.

3. The container of claim 2, said plurality of ribs being metal ribs made of a cold-weldable, corrosion-resistant material.

4. The container of claim 3 wherein the vessel-shaped body has a peripheral edge, said rib means including a rib plating covering said peripheral edge.

5. A container for the long-term storage of radioactive materials such as irradiated nuclear fuel elements, the container comprising:

a vessel-shaped base body made of a metal material, said base body having an outer surface and an opening through which the radioactive material to be stored therein is passed;

a plurality of corrosion-resistant metal ribs formed on said surface so as to partition said surface into a plurality of surface segments;

corrosion-resistant layer means applied to each one of said surface segments and being made of a corrosion-resistant material said metal ribs being made of a cold-weldable material and projecting outwardly above said corrosion-resistant layer means; and a cover adapted for sealing said opening of said vessel-shaped base body.

6. The container of claim 5, said metal material being selected from the group consisting of cast iron and cast steel and said corrosion-resistant material being made of a material selected from the group consisting of ceramic, graphite and enamel.

* * * * *

UNITED STATES PATENT AND TRADEMARK OFFICE

CERTIFICATE OF CORRECTION

PATENT NO. : 4,527,065

DATED : July 2, 1985

INVENTOR(S) : Franz-Wolfgang Popp and Klaus Rosenbach

It is certified that error appears in the above-identified patent and that said Letters Patent is hereby corrected as shown below:

In column 2, line 29: delete "planting" and substitute -- plating -- therefor.

In column 3, line 22: delete "cold weldable" and substitute -- cold-weldable -- therefor.

In column 3, line 58: delete "not" and substitute -- now -- therefor.

In column 4, line 47: add a semicolon after the word "material".

In column 4, line 50: add a comma after the word "and".

Signed and Sealed this

*First* Day of *July 1986*

[SEAL]

*Attest:*

DONALD J. QUIGG

*Attesting Officer*

*Commissioner of Patents and Trademarks*